United States Patent [19]

Edwards

[11] 4,294,027

[45] Oct. 13, 1981

[54] LIGHT WEIGHT SNOW THROWER

[75] Inventor: Merle L. Edwards, Port Washington, Wis.

[73] Assignee: FMC Corporation, San Jose, Calif.

[21] Appl. No.: 125,000

[22] Filed: Feb. 26, 1980

[51] Int. Cl.[3] ..... E01H 5/00

[52] U.S. Cl. ..... 37/43 R; 37/43 D

[58] Field of Search ..... 37/43 R, 43 A, 43 B, 37/43 C, 43 D, 43 E, 43 F, 43 G, 43 H, 43 R, 43 L, 53

[56] References Cited

U.S. PATENT DOCUMENTS

| | | | |
|---|---|---|---|
| 157,078 | 11/1874 | Parker et al. | 37/53 X |
| 2,879,611 | 3/1959 | Voigt | 37/53 X |
| 3,021,620 | 2/1962 | Rosenthal | 37/53 X |
| 3,359,661 | 12/1967 | Speiser et al. | 37/53 X |
| 3,488,869 | 1/1970 | Kaufman et al. | 37/43 R |
| 3,512,279 | 5/1970 | Benson | 37/43 R |
| 3,580,351 | 5/1971 | Mollen | 37/43 E X |
| 3,643,356 | 2/1972 | Gohl | 37/53 |
| 3,696,535 | 10/1972 | Kallio | 37/43 C |
| 3,742,626 | 7/1973 | Ellis | 37/43 R |
| 4,064,679 | 12/1977 | Spinner | 37/43 E X |

FOREIGN PATENT DOCUMENTS

| | | | |
|---|---|---|---|
| 927323 | 10/1947 | France | 37/43 R |

OTHER PUBLICATIONS

"Power to Go. Jacobsen Snowthrowers 1978", Sales Brochure, pp. 1-5.

"Snow-Mower", Rototiller Sales Brochure 1959, p. 1.

*Primary Examiner*—E. H. Eickholt

*Attorney, Agent, or Firm*—A. J. Moore; R. B. Megley

[57] ABSTRACT

A light weight compact snow thrower is disclosed having an extendable and forwardly foldable upper handle bar for operator convenience and for compact storage as in the trunk of an automobile. The snow thrower also includes a plurality of engine options between a 2.25 horsepower two cycle engine and a 5 horsepower four cycle engine, and further includes a chute and impeller width option without requiring alteration of the basic components of the light weight frame which incorporates the body of the larger engine as a structural component of the frame.

9 Claims, 9 Drawing Figures

63
134a
136a
16
62
60
58
52
14
10a
54
60
56
62
51
20
144
152
160
148
154
182
174
170
170
17
72
178
182
51
152
110
159
24
146
150
106a
22
180
Ea
108a
107a
T
72
76
44
72
78
82
105a
96
40
12
42
48
46
30
50
90
102
34
112
36
111
111
112
109
26
32
114
116
96
38

LIGHT WEIGHT SNOW THROWER

BACKGROUND OF THE INVENTION

Description of the Prior Art

Small light weight, walk behind snow throwers having a transverse impeller are well known in the art. Speiser et al U.S. Pat. No. 3,359,661 which issued on Dec. 26, 1967 discloses one such snow thrower which includes a two-bladed impeller which directs snow upwardly along a rear wall and through a plurality of open front vanes. The vanes are adjustable for deflecting the snow to the right, left, or forward relative to the path of movement of the snow thrower. This patent discloses a rigid handle bar assembly having upper and lower transverse grip portions.

Chase U.S. Pat. Nos. 4,138,829; 4,138,830; and 4,138,831 which issued on Feb. 13, 1979 disclose similar snow throwers but with a generally rectangular chute having its front closed by a wall adjacent the upper end thereof. A two paddle impeller directs snow through the chute for selective discharge to the right or left by adjustable vanes within the chute. These Chase patents disclose two U-shaped handle bars with one handle bar rigidly secured to the base of the snow thrower and having a transverse portion bent over the engine housing while a second U-shaped handle bar is secured to and projects upwardly from the lower handle bars. The upper handle bar is mounted for pivotal movement downwardly and to the rear of the snow thrower when the snow thrower is to be stored.

A third apparently unpatented snow thrower is known which includes a U-shaped upper handle with a transverse grip portion and a lower transverse grip that is integrally formed with the engine housing and has a width which will accommodate only one hand of the operator. The upper handle is apparently adjustable in height but is non-foldable.

French Pat. No. 927,323 which was published on Oct. 27, 1947 is also pertinent in that it discloses a transversely oriented driven impeller which guides snow along an arcuate portion of a back plate which then curves upwardly and forwardly to direct the snow through a chute having transversely adjustable vanes therein, which vanes discharge the snow to the right or to the left of the path of movement of the snow thrower.

SUMMARY OF THE INVENTION

In accordance with the present invention, a light weight snow thrower is disclosed having a sturdy, light weight metal frame for supporting the working components of the snow thrower. The metal frame includes upper and lower transverse handle bars, which upper handle bar is adjustable for height, and is also foldable over the engine housing for compact storage when the snow thrower is not in operation. The sturdy metal frame includes an engine base and drive support permitting the installation of a low 2.25 horsepower (1.7 kw) two cycle engine, an intermediate 3.5 horsepower (2.6 kw) four cycle engine, or a large 5 horsepower (3.7 kw) four cycle engine. All of the above engines drive a 3 paddle impeller.

The snow thrower also includes an engine housing defined in part by upper and lower engine housing covers which cooperate with the engine base and other frame components to retain hot exhaust gases within the housing before release through a one-piece drive-heat shield exhaust deflector thereby preventing icing of the carburetor, and also warming the engine for more efficient operation. The snow thrower with the small 2.25 horsepower two cycle engine weighs about 42 pounds (19.0 kg); the snow thrower with a 3.5 horsepower four cycle engine weighs about 50 pounds (22.7 kg); and the snow thrower with the large 5 horsepower engine weighs about 52 pounds (22.7 kg).

Accordingly, a feature of the invention is to provide a light weight snow thrower having an upper handle bar adjustable for operators of different heights, and also foldable forwardly over the snow thrower housing in a compact storage position so that a person can grip the lower handle bar with two hands and easily lift the snow thrower into the trunk of a car or the like.

Another feature of the invention is to provide a light weight, but sturdy, metal frame design which will accommodate two and four cycle engines between about 2.25 to 5 horsepower; and which frame uses the bodies of the larger engines as structural frame members. The frame design also permits the use of different widths snow discharging chutes without changing the basic frame structure except for width of the snow guiding chute and impeller.

A further feature of the invention is to provide an engine housing which retains hot exhaust gases therein to reduce engine noise, to prevent icing of the carburetor, and to raise the operating temperature of the engine to improve the engine's performance.

DESCRIPTION OF THE PREFERRED EMBODIMENT

Although three embodiments of the snow thrower 10 (FIGS. 1–6); 10*a* (FIG. 7) and 10*b* (FIG. 8) are disclosed, it will be understood that major portions of the three snow throwers are identical, and accordingly reference to FIGS. 1–6 will be used to describe the first embodiment. Parts of the second embodiment 10*a* (FIG. 7) which are the same as the first embodiment will be assigned the same numerals as those used in the first embodiment without suffix. Only those parts of the second embodiment which differ from the first embodiment will be assigned numerals followed by the letter "a". Similarly, the parts of the third embodiment which are identical to those of the first or second embodiment will be assigned the same numerals (without suffix) used in the first and second embodiments, and only those parts that differ from the first or second embodiment will be assigned numerals followed by the letter "b".

Briefly, the differences between the first embodiment of the snow thrower 10 and the second embodiment of the snow thrower 10*a* (FIG. 7) is that the first embodiment is powered by a 2.25 horsepower two cycle engine E (FIGS. 4 and 6) while the second embodiment is powered by a 3.5 horsepower four cycle engine Ea (FIG. 7) which requires the use of different engine mounting components and a heat deflector and also is provided with a deadman's clutch. The differences between the second embodiment and the third embodiment are that a wider chute and impeller are used in comparison to that used in the second embodiment. Also a larger 5 horsepower, four cycle engine Eb is used in the third embodiment, but the large engine has the same external dimensions and mounting means as the 3.5 horsepowr engine Ea.

Figure 1:
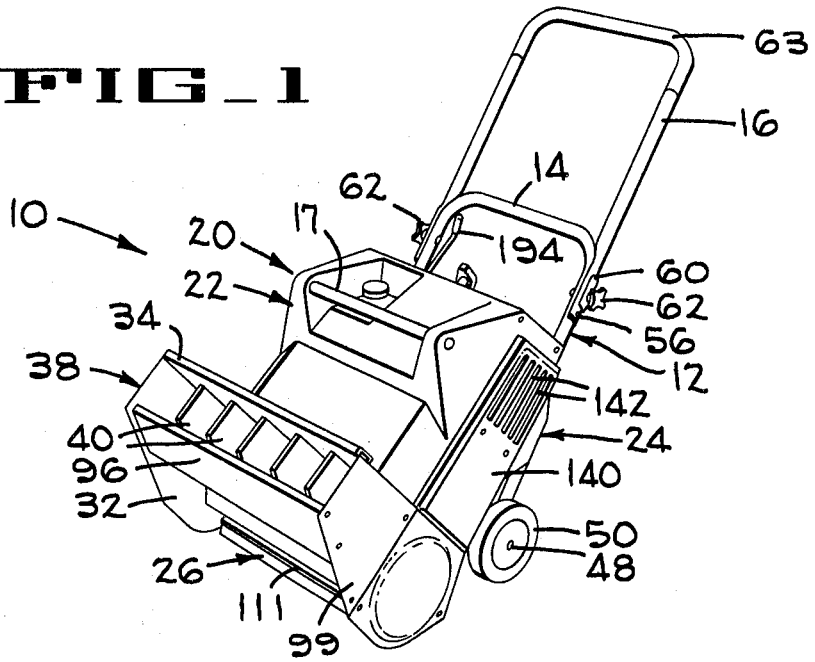
FIG. 1 is a perspective of the first embodiment of the snow thrower of the present invention illustrated in its operative position.
Figure 2:
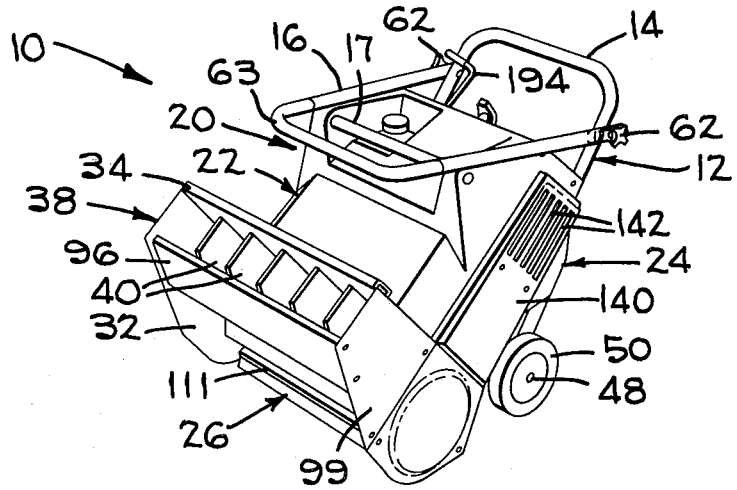
FIG. 2 is a perspective of the snow thrower of FIG. 1 with its upper handle bar folded in storage position.

In general, the snow thrower 10 of the first embodiment (FIGS. 1–4) of the present invention comprises a light weight metal frame 12 which includes a U-shaped handle bar support 14 and a U-shaped upper handle bar 16 which is adjustable for height differences of operators and is also pivotal between an operative position (FIG. 1) and a storage position (FIG. 2). A lower handle bar 17 is positioned above the snow thrower at its longitudinal center of gravity. The two cycle engine E (FIG. 4) is mounted on the frame 12 (best shown in FIG. 7) within an engine housing 20 partially defined by a plastic upper cover 22 and a plastic lower cover 24 secured to the frame 12. The engine E drives an impeller 26 (FIG. 4) in a counterclockwise direction through a belt drive 28. The impeller 26 is journalled in a metal drive support 30 and a metal side plate 32 (FIG. 3) of the frame 12. The impeller 26 throws snow upwardly along a forwardly sloping rear wall or backplate 34 having a lower arcuate portion 36 concentric with the axis of the impeller. The snow is thrown through a chute 38 having vanes 40 therein which are selectively pivoted between positions deflecting the snow to the right, to the left, or forward of the snow thrower's path of travel.

Figure 3:
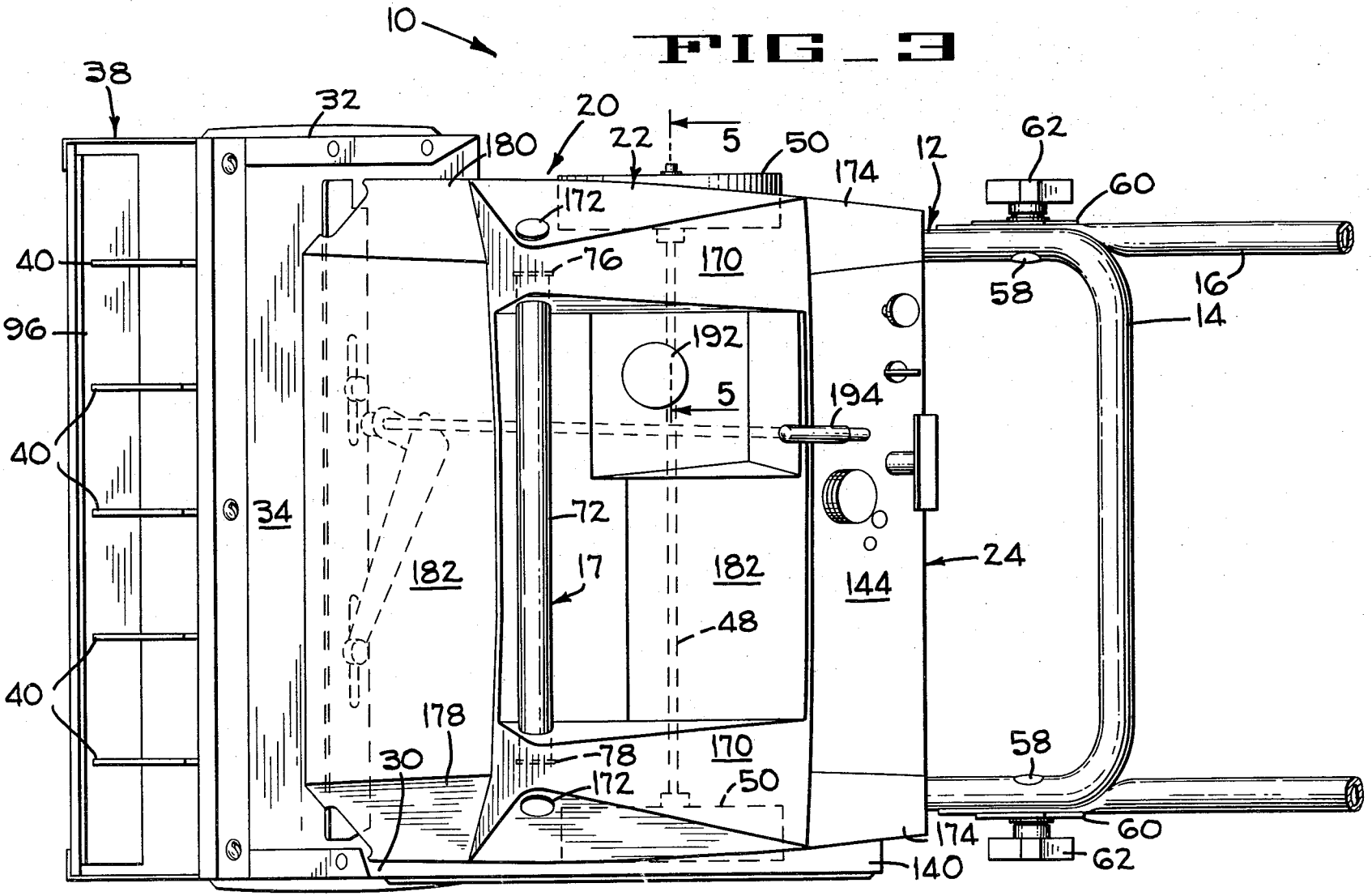
FIG. 3 is an enlarged plan of the snow thrower with the upper handle bar cut away.
Figures 4, 5:
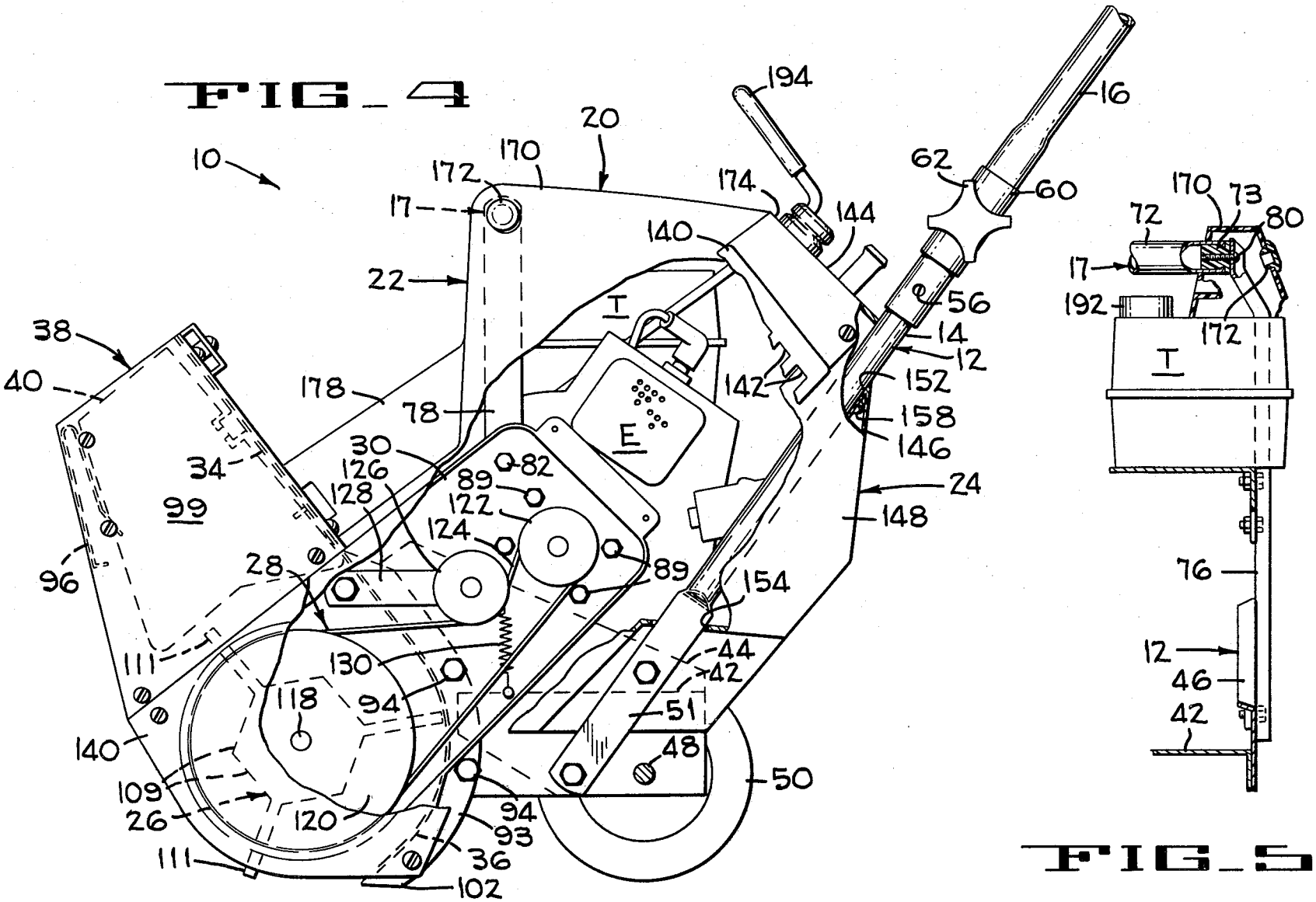
FIG. 4 is an elevation of the snow thrower of FIG. 3, with a two cycle engine therein, certain parts being cut away to illustrate the impeller drive and other internal components.
FIG. 5 is a vertical section taken along lines 5—5 of FIG. 3 illustrating the structure for mounting the lower handle bar within the upper housing and to the metal frame.

More particularly, the metal frame 12 includes a flanged engine base 42 (FIGS. 4 and 7) which has vertically extending angle support members 44,46 bolted thereto and extending above the engine base to receive an axle 48 to which two wheels 50 are journaled. Lower flattened ends 51 of the U-shaped handle bar support 14 are bolted to the support members 44,46 and to the engine base 42. The handle bar support 14 also has bolt holes near its upper end. The U-shaped upper handle bar 16 has its lower ends arcuately flattened and provided with pairs of vertically spaced holes 54,56 which receive bolts 58 that extend through the bolt holes 52, and 54 or 56. The upper handle bar 16 is tightly secured to the handle bar support 14 by arcuate reinforcing plates 60 and knobs 62 screwed onto the bolts 58 as illustrated in FIGS. 3 and 4. The upper handle bar also includes a transverse grip portion 63.

The lower handle 17, which defines a portion of the frame 12, includes a long metal tube 72 that extends transversely across the snow thrower at its fore and aft center of gravity. Flanged plugs 73 are inserted in the ends of the tube 72 and are provided with external annular grooves so that the end portions of the tube 72 may be rolled or staked into the groove to lock the plugs to the tube. The plugs are threaded and are releasably secured to the upper ends of a right channel strap 76 and a left strap 78 by screws 80 (FIG. 5). The lower end of the strap 76 is rigidly secured as by bolting to the angle support member 46. The lower end of the strap 78 is connected to the drive support 30 by a bolt 82.

The previously described connection of the upper handle bar 16 to the handle bar support makes it possible to fold the upper handle bar 16 forwardly of the handle 17 over the snow thrower as illustrated in FIG. 2 in a compact, substantially horizontal position so that the snow thrower can easily be placed in the trunk of a car and be carried from place to place or be stored in a small area.

Folding of the upper handle bars 16 merely requires loosening of the knob 62 and folding the handle bar 16 forwardly. Also, by positioning the bolt 58 in either the upper pair of holes 54 or the lower pair of holes 56, the handle bar 16 may be adjusted for tall or short operators, respectively.

The light weight metal frame 12 also includes the metal drive support 30 (FIGS. 6 and 7) and the metal side plate 32 which rotatably supports the impeller 26.

Figure 6:
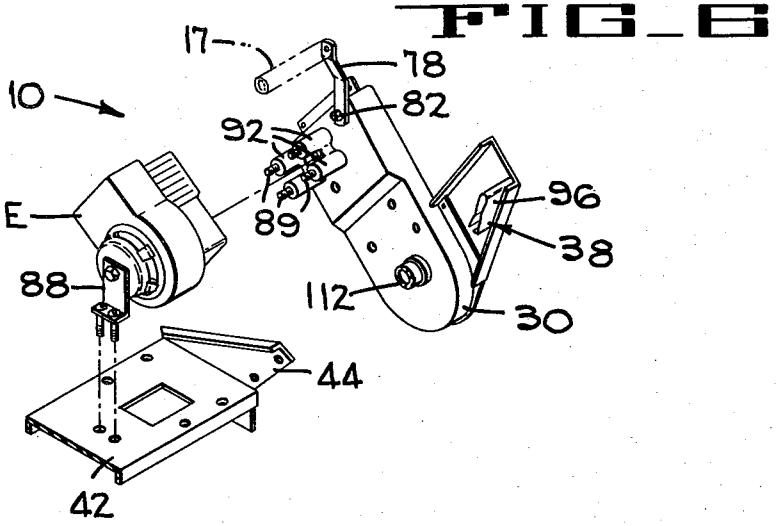
FIG. 6 is an exploded perspective illustrating the two cycle engine of the first embodiment and the structure for mounting the same to the light weight frame.

When the two cycle engine E (FIG. 4) of the first embodiment is used to power the impeller of the snow thrower 10, the engine is not directly bolted to the base 42 and does not include bottom feet as illustrated in FIG. 6. Instead, the starter housing of the engine 10 is bolted to an angle bracket 88 (FIG. 6) which is bolted to the base 42. The other end of the engine E is connected by four threaded connectors 89 such as capscrews (or studs and nuts) which extend through the drive support 30 and a spacer 92 (FIG. 6) and are screwed into the engine E. The engine E is thus mounted in a rearwardly inclined position as shown in FIGS. 4 and 6 with a portion of the drive support 30 being fitted within a slot 90 (FIG. 7) in the back plate 34. The intermediate portion of the drive support 30 is bolted to a flange 93 (FIG. 4) formed on and projecting rearwardly from the backplate 34 and to the left support member 44 by three capscrews 94. The right side of the backplate 34 is provided with a similar rearwardly extending flange (not shown) which is connected to the right support member 46 by capscrews (not shown) but aligned with capscrews 94 (FIG. 4).

The right side of the snow thrower 10 includes the metal side plate 32 (FIG. 7) which is flanged and is bolted to the right side of the backplate 34 and to the right end of a front wall 96 of the chute 38. The other end of the front wall 96 is bolted to the upper portion of a flanged chute wall 99 which is connected to the backplate 34 and drive support 30 by screws.

The snow throwers that are powered by the 2.25 horsepower engine E of the first embodiment, and also by the 3.5 horsepower engines Ea of the second embodiment are provided with chutes 38 and cooperating impellers 26 which will remove the snow from a 20 inch (51 cm) path of snow, while the 5 horsepower snow thrower 10*b* (FIGS. 8 and 9) removes snow from a 24 inch (61 cm) path and thus includes a wider impeller 26*b* and chute 38*b*. A lower support strap 100*b* (FIGS. 8 and 9) is provided only on the 24 inch wide snow thrower chute 38*b* to more effectively support the extended end of the chute 38*b*. One end of the strap is bolted to the lower right hand edge of the backplate 34*b*, and the other end is bolted to the lower edge of the right angle support member 46*b* and engine base as illustrated in FIG. 8.

Figure 8:
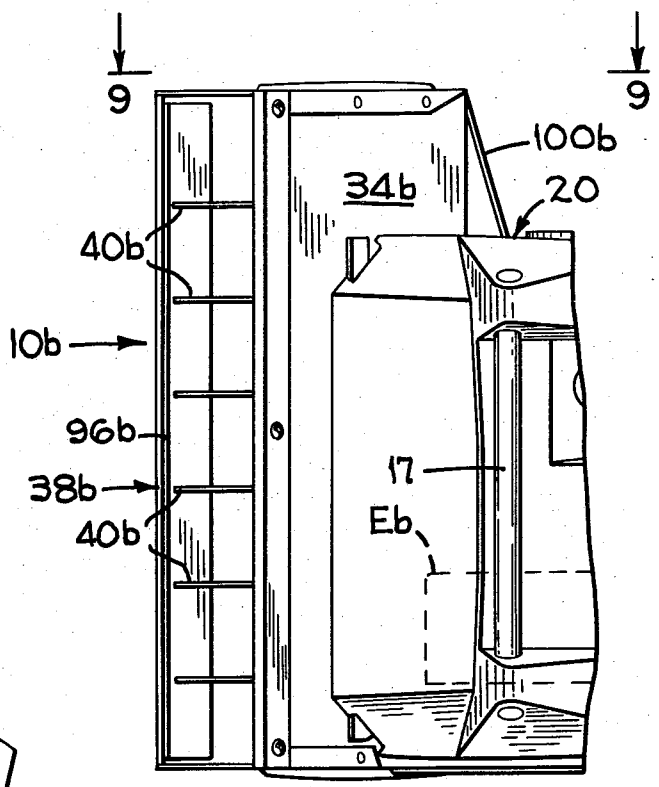
FIG. 8 is a plan of a portion of a third embodiment of the invention which is the same as the second embodiment except that the chute and impeller are wider and are powered by a large four cycle engine.
Figure 9:
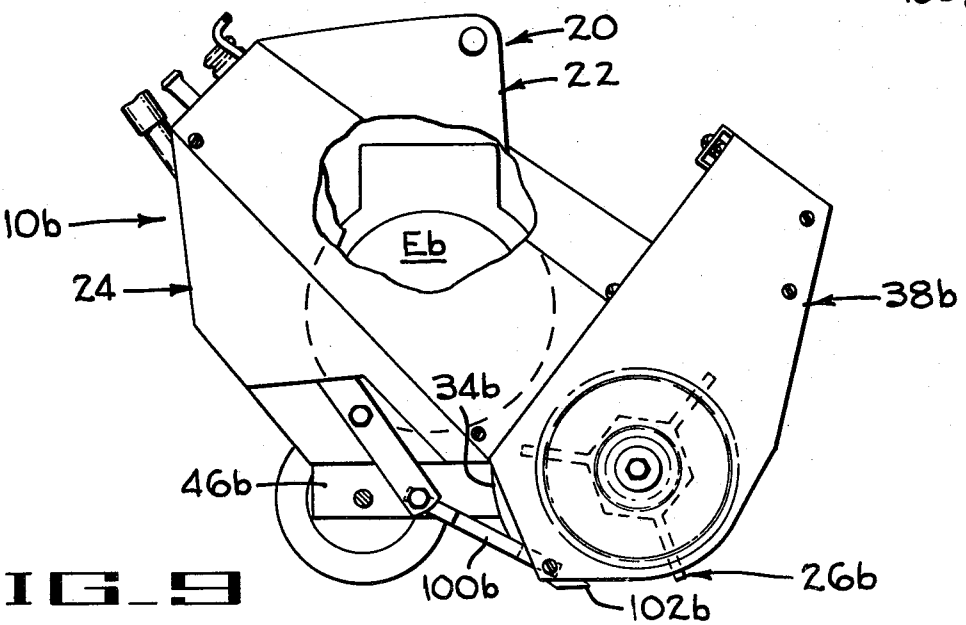
FIG. 9 is a side elevation looking in the direction of arrows 9—9 of FIG. 8 illustrating the right side of the snow thrower of FIG. 8, certain parts being cut away.
Figure 7:
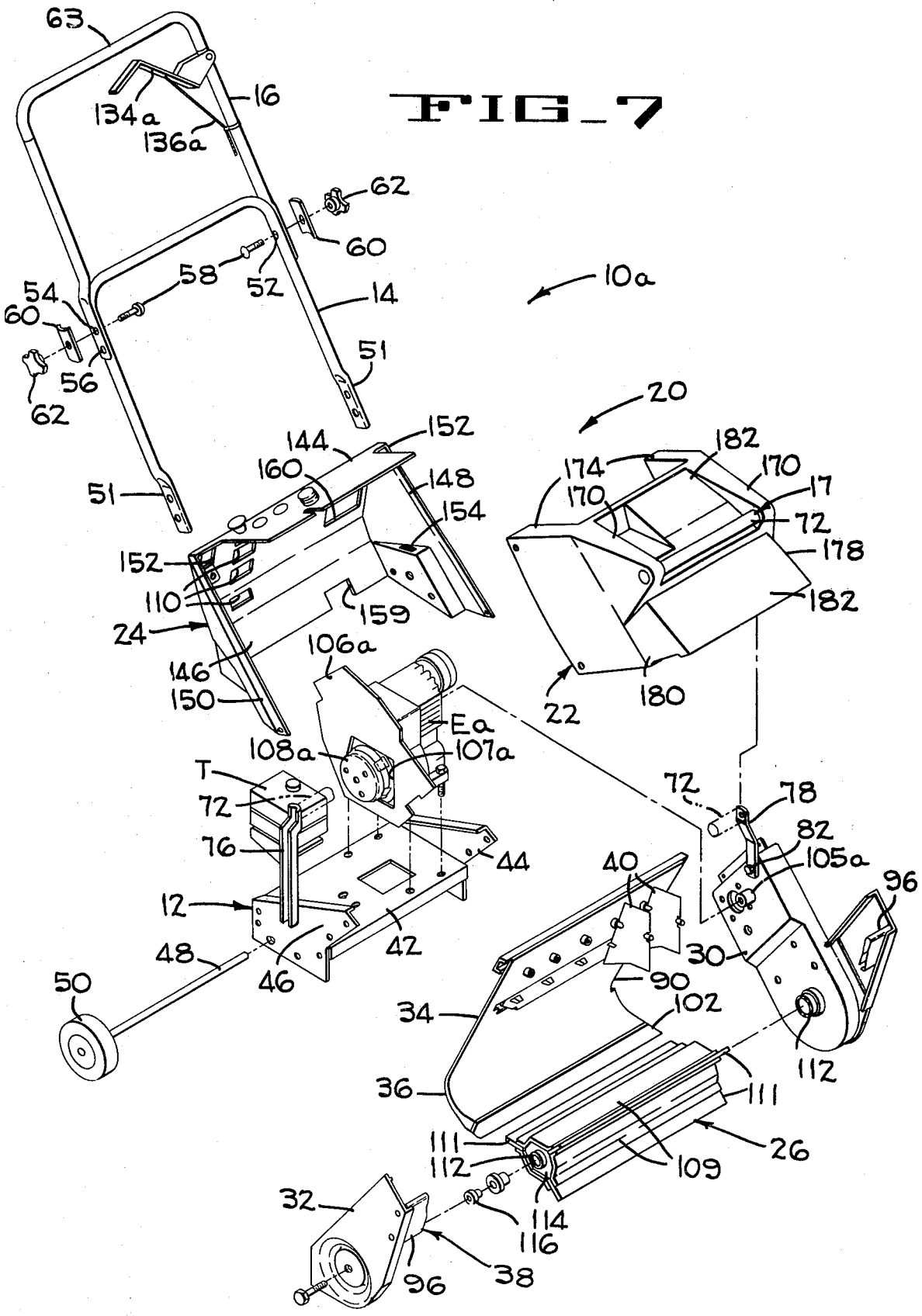
FIG. 7 is a diagrammatic exploded perspective illustrating a second embodiment of the invention which is the same as the first embodiment except that a four cycle engine, a deadmans clutch, and several components cooperating with the engine have been substituted for the two cycle engine and associated components of the first embodiment.

As indicated in FIGS. 7 and 8, a snow scraper 102,102*b* of proper length is bolted to the forward lower edge of the backplate 34,34*b* of both size chutes 38,38*b*.

When using the four cycle 3.5 horsepower (2.6 kw) engine Ea of the second embodiment of the snow thrower 10*a* (FIG. 7), or the 5 horsepower (3.7 kw) engines Eb (FIG. 8), the engines Ea and Eb are the same external size and include feet which are bolted directly to the engine base 42 as indicated in FIG. 7. The four cycle engines also define a structural element for the light weight frame since they are connected to the drive support 30 by a single capscrew which extends through the support 30 and through a tubular spacer 105*a* and is screwed into the body of the engine Ea. When using the four cycle engines Ea or Eb, the engine is mounted on the base plate in a vertical position. Also, when using the four cycle engines a deflector plate 106*a* (FIG. 7) is provided and cooperates with the engine housing 20 to divide the housing into two compartments and to isolate the fuel tank from the engine Ea. The deflector plate 106*a* has a large central air opening 107*a* and is bolted to the right side of the engine Ea which side of the engine includes the engine starter housing 108*a* (FIG. 7) and an internal air cooling fan (not shown). The fan draws cooling air through four air inlet openings 110 in the lower housing cover 24 and through the opening 107*a* to cool the larger engines. As previously mentioned, the portion of the housing on the left side of the deflector plate 106*a* is heated by the exhaust gases (and the warmed cooling air) to prevent icing of the carburetor and warming of the engine for more efficient operation.

As best shown in FIG. 7, the impeller 26 for both the first and second embodiments is formed from three generally V-shaped paddle support members 109 having three equally spaced, transversely extending paddles 111 clamped therebetween by bolts. The paddles are flexible and are formed of a material such as rubber or the like. The support members 109 and paddles are secured to a tubular shaft 112 by end pieces 114. One end of the tubular impeller shaft 112 receives a bushing which is journaled on a stub shaft 116 bolted to the side plate 32; and the other end of the impeller is welded to a stub shaft 118 (FIG. 4) that is journaled in a bushing (not shown) secured to the drive support 30 and is rigidly secured to a driven pulley 120 (FIG. 4) of the impeller belt drive 28.

The belt drive 28 comprises a drive pulley 122 secured to the output shaft of the engine, a drive belt 124 trained over the pulleys 120 and 122, and an idler pulley 126 journaled on an arm 128 pivoted to the drive support 30. When the low 2.25 horsepower engine E of the first embodiment is being used to drive the impeller, a spring 130 connected between the arm 128 and the drive support 30 urges the roller downwardly to tension the belt 124.

When using the four cycle 3.5 or 5 horsepower engines to drive the impeller, the spring 130 is removed and a deadman's clutch is provided to engage or disengage the associated impeller. The deadman's clutch is actuated by a clutch lever 134*a* (FIG. 7) pivoted to the upper handle bar 16 and is connected to the idler arm 128 (FIG. 4) by conventional means including a cable type linkage 136*a* with a resilient element therein. The deadman's clutch urges the idler pulley 126 into belt tensioning position only when the gripping portion of the lever 134*a* is held against the transverse portion 63 of the upper handle 16.

As best shown in FIG. 1 a combination drive cover-heat shield exhaust deflector 140 is removably connected to the drive support 30 by screws. The deflector 140 is provided with louvers 142 for directing hot exhaust gases from the engine housing 20, and the deflector 140 is flanged and tightly engages the flanged drive support 30 so that hot exhaust gases will not damage the drive belt 124.

A feature of the invention is that the engine housing 20 retains hot exhaust gases around the engine to prevent carburetor icing and to also provide for more efficient operation of the engine. The housing 20 also aids in reducing engine noise.

The engine housing comprises the upper plastic cover 22 (FIGS. 4 and 7), the lower plastic cover 24, the rear surface of the backplate 34, the engine base 42, and the drive cover-head shield exhaust deflector 140 (FIGS. 1 and 4) which cooperates to retain heat within the housing and direct the exhaust gases primarily out of the louvers 142.

As best shown in FIGS. 4 and 7, the lower cover 24 is provided with an instrument panel 144, a bottom wall 146, and side walls 148,150. The forward edge of the bottom wall 146 engages the rearward flanged edge of the engine base 42, while the forward edges of the side walls 148,150 engage the rear wall of the backplate 34. The sidewalls 148,150 are bolted to the angle support member 44,46, and the side walls are provided with upper slots 152, and lower slots 154 to allow the lower ends of the handle bar support 14 to enter the bottom wall 146 through slots 152 and then pass outside of the sidewalls 148,150 through slots 154. Thus, when the lower flattened end portions of the handle bar support 14 are bolted to the angle support members, the side walls 148, 150 are firmly clamped to the support members 44,46.

In order to provide additional rigidity to the lower cover 24, the lower walls defining the slots 152 are connected to the handle bar support 14 by screws 158 (FIG. 4). As shown in FIG. 7, the lower housing cover 24 is provided with apertures such as the coolant air inlet openings 110, an oil drain opening 159, and an air opening 160 for the carburetor. Other ports are provided to receive the usual engine controls.

The upper housing cover 22 (FIGS. 1–6) comprises a pair of upstanding inverted channel members 170 which have large openings in the inner walls for receiving the lower handle 17 (FIGS. 1 and 5), and have aligned openings in the outer walls for access of a screw driver or the like for inserting or removing the screws 80 which secure the lower handle bar 17 to the metal frame member 76,78. Snaps or plugs 172 are provided to seal the outer holes for appearance, and for reducing vandalism to the engine by hiding the handle bar screws 80 which must be disconnected before the upper cover 22 can be removed to gain access to the engine. The upper housing cover also includes an inverted U-shaped rear wall 174, which nests about the instrument panel 144, side walls 178,180 and an upper wall 182. The forward edges of the side wall 178,180 and upper wall 182 abut the rear surface of the backplate 34. The lower edges of the side walls 178 is cut away and abuts the upper surface of the exhaust deflector 140, while the side wall 180 is connected to the upper edge of the sidewall 150 of the lower cover 24 by screws. The upper wall 182 is apertured to receive the filling spout and cap 192 of the fuel tank T thus permitting refueling without removing the upper housing cover.

As mentioned previously, when using either the 2.25 or 3.5 horsepower engines, the width of the chute will clear about a 20 inch (51 cm) path through the snow. However, when using the large 5 horsepower engine, the snow thrower 10 preferably clears snow from about a 24 inch (61 cm) path. The only changes to the snow thrower **10*b* (FIGS. 8 and 9) relative to the snow thrower 10*a* when used to clear a 24 inch path is to provide the large engine Eb; and to provide the wider impeller 26*b*, the wider backplate 34*b*, the wider front wall 96*b*, the brace 100*b*, and to add one additional vane 40*b* and its actuating mechanism within the chute 38*b***.

The vanes 40 (FIGS. 3 and 7) may be pivoted in a known manner by pivoting a handle 194 (FIGS. 3 and 4) from the illustrated position to the right or left to direct the snow forward, to the right, or to the left, respectively.

In operation, the selected engine is started and the operator pushes the snow thrower forward through the snow while grasping the transverse grip portion 63 of the upper handle bar 16 and if necessary, the lower handle bar 17. If the snow thrower is provided with a deadman's clutch, the operator must hold the clutch lever **134*a* (FIG. 7) against the transverse portion 63 of the upper handle bars 16 to engage and drive the impeller 26. As the operator pushes the snow thrower forward, the three impeller paddles 111 force the snow rearwardly and along the backplate 34 for discharge upwardly and through the vanes 40. The vanes may be adjusted by actuation of the handle 194** to direct the snow to the right, to the left, and forwardly.

From the foregoing description it is apparent that the snow thrower of the present invention includes a handle bar arrangement which is both adjustable for operator height differences, and which also includes a forwardly foldable upper handle bar which permits the snow thrower to be easily lifted and stored in compact areas such as the trunk of a car. The snow thrower also includes a light weight but sturdy frame which accommodates both two cycle and four cycle engines having between about 2.25 and 5 horsepower ratings and at the same time maintaining the weight of the largest 5 horsepower snow thrower below about 52 pounds (23.6 kg). The snow thrower further features an enclosed engine housing for retaining heat from exhaust gases released therein which prevents carburetor icing and warms the engine for more efficient operation, with the exhaust gas being discharged from the housing through louvers formed in a one piece drive cover-heat shield exhaust deflector.

Although the best mode contemplated for carrying out the present invention has been herein shown and described it will be apparent that modification and variation may be made without departing from what is regarded to be the subject matter of the invention.

I claim:

1. A light weight compact snow thrower having an engine; a transversely extending chute; and a transverse impeller driven by the engine: the improvement which comprises means defining a light weight metal frame for supporting the engine and chute; a lower transversely extending handle bar included in said metal frame; an upper handle bar support included in said frame means and extending upwardly and rearwardly relative to the engine; an upper handle bar having a transverse gripping portion; adjustment means releasably securing said upper handle bar to said handle bar support for height adjustment and also for folding the upper handle bar between an operative position extending rearwardly of said engine and a storage position wherein said transverse gripping portion extends forwardly of said engine; a non-metallic engine housing; said engine housing including a lower cover secured to said frame, an upper cover removably secured to said frame and said lower cover, said lower handle bar having an exposed intermediate gripping portion and having end portions projecting within said upper cover, means defining two access openings in said upper cover adjacent said end portions, connector means for removably connecting said end portions to portions of said metal frame enclosed within said housing, and plug means for closing said two access openings after said lower handle bar has been connected to said frame means for minimizing vandalism to said engine.

2. An apparatus according to claim 1 wherein said handle bar support includes a pair of elongated legs having flat lower ends, and wherein said lower cover includes means defining a pair of upper apertures and means defining a pair of lower apertures for receiving portions of said legs within the lower cover while the flattened end portions extend outwardly of said lower cover portions, and second connector means for clamping said lower cover portions between components of said metal frame and said flat end portions.

3. An apparatus according to claim 1 wherein said connector means are screws, and wherein a screw driver is inserted through the access openings for connecting or releasing the screws from said lower handle bar.

4. A light weight compact snow thrower having a plurality of available engine options to be selected for use to power the snow thrower comprising: a light weight frame; said frame including means defining an engine base having a generally horizontal surface with upstanding side members extending longitudinally of the snow thrower, and a drive support secured to one of said members and extending upwardly and downwardly from said engine base; a chute supported by said frame; an impeller journaled in said chute; an engine having a shaft and a body; first means connecting one side of said engine body to said drive support; second means connecting said engine body to said horizontal surface; drive means connecting said engine shaft to said impeller for rotating the same; and wheels journaled on said frame for supporting said frame for movement;

when said engine option to be used is a small 2.25 horsepower two cycle engine, said engine being spaced above and having its cylinder inclined to said horizontal surface of said engine base, said first connecting means being defined by a spacer having a plurality of threaded connectors extending therethrough and through said drive support for threaded connection to the small engine, said second connecting means being a bracket secured to the base and to the other side of the engine;

when said engine option is a larger four cycle engine within a horsepower range of about 3.5 to 5 horsepower, said engine being directly supported by feet on said base, said second connecting means being connectors rigidly securing the feet to said horizontal surface of said engine base, said first connecting means including a tubular spacer and a threaded connector extending therethrough and through said drive support for threaded connection to said larger engine.

5. An apparatus according to claim 4 having an impeller and chute width options, said chute and impeller being a first predetermined width when said impeller is powered by said small first engine, and being of a second predetermined width which is larger than said first width when powered by said large five horsepower engine.

6. A light weight compact snow thrower having a plurality of available engine options to be selected for use to power the snow thrower comprising: a light weight frame; said frame including means defining an engine base having a generally horizontal surface with upstanding side members extending longitudinally of the snow thrower, and a drive support secured to one of said side members and extending upwardly and downwardly from said engine base; a chute supported by said frame; an impeller journaled in said chute; an engine having a shaft and a body; means connecting one side of said engine body to said drive support; drive means connecting said engine shaft to said impeller for rotating the same; and wheels journaled on said frame for supporting said frame for movement; said connection means acting as a connecting link which completes a generally triangular frame component with the sides of the triangle being defind by a portion of said engine body, said engine base, and said drive support, thereby reducing the weight of said frame.

7. A light weight compact snow thrower having a plurality of available engine options to be selected for use to power the snow thrower, comprising: a light weight frame; said frame including means defining an engine base having a generally horizontal surface with upstanding side members extending longitudinally of the snow thrower, and a drive support secured to one of said side members and extending upwardly and downwardly from said engine base; a chute supported by said frame; an impeller journaled in said chute, an engine having a shaft and a body; means connecting one side of said engine body to said drive support; drive means connecting said engine shaft to said impeller for rotating the same; wheels journaled on said frame for supporting said frame for movement; means defining a temperature controlling housing supported by said frame and enclosing said engine; said selected engine including a muffler within said housing for directing exhaust gases within said housing to further lower the engine noise while warming the engine and precluding icing of the carburetor; vent means included in said housing through which the exhaust gases are released; said chute having a rear surface; said means defining said temperature controlling housing including said engine base; said rear surface of said chute; said vent means; the lower cover having lower generally horizontal edges abutting said side member and a rear surface of said engine base; and an upper cover having front edges abutting said rear chute surface, a rear wall and one side wall abutting said lower cover, and a second side wall abutting said lower cover and said vent means.

8. A light weight compact snow thrower having a plurality of available engine options to be selected for use to power the snow thrower, comprising: a light weight frame; said frame including means defining an engine base having a generally horizontal surface with upstanding side members extending longitudinally of the snow thrower, and a drive support secured to one of said side members and extending upwardly and downwardly from said engine base; a chute supported by said frame; an impeller journaled in said cute, an engine having a shaft and a body; means connecting one side of said engine body to said drive support; drive means connecting said engine shaft to said impeller for rotating the same; wheels journaled on said frame for supporting said frame for movement; means defining a temperature controlling housing supported by said frame and enclosing said engine; said selected engine including a muffler within said housing for directing exhaust gases within said housing to further lower the engine noise while warming the engine and precluding icing of the carburetor; vent means included in said housing through which the exhaust gases are released; said vent means being a one piece combination drive cover heat shield exhaust deflector secured to said drive support and having louvers for directing the hot gases from the temperature control housing.

9. A light weight compact snow thrower having a plurality of available engine options to be selected for use to power the snow thrower, comprising: a light weight frame; said frame including means defining an engine base having a generally horizontal surface with upstanding side members extending longitudinally of the snow thrower, and a drive support secured to one of said side members and extending upwardly and downwardly from said engine base; a chute supported by said frame; an impeller journaled in said chute, an engine having a shaft and a body; means connecting one side of said engine body to said drive support; drive means connecting said engine shaft to said impeller for rotating the same; wheels journaled on said frame for supporting said frame for movement; means defining a temperature controlling housing supported by said frame and enclosing said engine; said selected engine including a muffler within said housing for directing exhaust gases within said housing to furhter lower the engine noise while warming the engine and precluding icing of the carburetor; vent means included in said housing through which the exhaust gases are released; the selected engine being provided with a cooling fan which draws air from the other side of said engine body for cooling the engine; an engine deflector secured to said other side of the engine body and having a large air inlet opening communicating with the fan, said engine deflector including a peripheral edge which mates with the internal surfaces of said temperature controlling housing means for dividing said housing into a cooling air compartment and a heated compartment, and means defining an air inlet opening in said cooling compartment.

* * * * *